US009789373B2

(12) United States Patent
Cheng

(10) Patent No.: US 9,789,373 B2
(45) Date of Patent: Oct. 17, 2017

(54) HEAD FRAME OF GOLF BAG

(71) Applicant: Kai-Lun Cheng, Yuanli Township (TW)

(72) Inventor: Kai-Lun Cheng, Yuanli Township (TW)

( * ) Notice: Subject to any disclaimer, the term of this patent is extended or adjusted under 35 U.S.C. 154(b) by 0 days.

(21) Appl. No.: 15/267,251

(22) Filed: Sep. 16, 2016

(65) Prior Publication Data

US 2017/0001084 A1 Jan. 5, 2017

Related U.S. Application Data

(63) Continuation of application No. 14/151,503, filed on Jan. 9, 2014, now abandoned.

(30) Foreign Application Priority Data

Jun. 13, 2013 (TW) ..... 102211062 U

(51) Int. Cl.
*A63B 55/00* (2015.01)
*A63B 55/40* (2015.01)

(52) U.S. Cl.
CPC ..... *A63B 55/40* (2015.10); *A63B 55/00* (2013.01)

(58) Field of Classification Search
CPC ..... A63B 55/40; A63B 55/00
See application file for complete search history.

(56) References Cited

U.S. PATENT DOCUMENTS 2,860,679 A * 11/1958 Kouke ..... A63B 55/00 206/315.6
3,901,299 A * 8/1975 Picco ..... A63B 55/00 206/315.4
5,134,250 A * 7/1992 Caveney ..... H02G 3/0418 138/162
5,274,194 A * 12/1993 Belcher ..... H02G 3/0418 174/50
5,899,328 A * 5/1999 Dulyea, Sr. ..... A63B 55/00 206/315.3
5,950,825 A * 9/1999 Shin ..... A63B 55/00 206/315.3
6,105,792 A * 8/2000 Chang ..... A63B 55/00 206/315.3
6,284,974 B1 * 9/2001 Albert ..... H02G 3/0418 174/68.3
9,586,109 B2 * 3/2017 Martell ..... A63B 55/40
2004/0035729 A1 * 2/2004 Chang ..... A63B 55/50 206/315.6

(Continued)

*Primary Examiner* — Tri Mai
(74) *Attorney, Agent, or Firm* — Jackson IPG PLLC; Demian K. Jackson

(57) ABSTRACT

The invention provides a head frame for golf bag and comprises an annular frame and a separator. At least one inserting part is fitted at inner side of the frame body with a slot with open side up and a guide block at one side of the slot. This separator has an annulus and a separating frame connected at the inner side of the annulus. The annulus can be inserted in the slot in a demountable way, while, the separating frame divides the inner side of annulus into several compartments for golf club placement. Whereby, users can select separators with different compartment quantities and assemble them on the head frame according to individual requirements for a good elasticity and light weight.

4 Claims, 6 Drawing Sheets

(56) References Cited

U.S. PATENT DOCUMENTS

| | | | | |
|---|---|---|---|---|
| 2006/0108243 | A1* | 5/2006 | Tan | A63B 55/00 206/315.6 |
| 2010/0320105 | A1* | 12/2010 | Aubery | A63B 55/00 206/315.7 |
| 2011/0073504 | A1* | 3/2011 | Aubery | A63B 55/00 206/315.6 |
| 2014/0034527 | A1* | 2/2014 | Anderson | A63B 55/00 206/315.6 |

* cited by examiner

HEAD FRAME OF GOLF BAG

BACKGROUND OF INVENTION

1. Field of the Invention

This is a continuation application of Ser. No. 14/151,503 filed on Jan 9, 2014.

The present invention relates generally to a golf bag and more particularly to a head frame of golf bag with good using elasticity and light weight.

2. Description of Related Art

A separator is fitted inside the head frame of golf bag to separate the inner head frame into several compartments available for users to place golf clubs with different numbers in different compartments. To achieve a light weight, the head frame and separator are generally made of plastic materials. At present, the head frame and separator of golf bag are of an all-in-one structure, where, the quantity of compartments of the separator cannot be changed. Moreover, there were products assembling the head frame and separator in an insertion way. For example, in U.S. Pat. No. 8,141,705, several scarfing slices fitted at one side of the separator can be clamped in the insertion hole to fix the separator inside the head frame.

Since the head frame and separator are made of plastic materials, the scarfing slices of the separator will wear down slightly after inserted into the head frame. Meanwhile, the head frame, separator and scarfing slices will deform slightly due to a long-term temperature variation. Therefore, although the head frame and separator in U.S. Pat. No. 8,141,705 are of an insertion structure and seem demountable and mountable, their bonding strength will decrease greatly after the separator is demounted from the head frame and remounted. Thus, the head frame and separator of this U.S. Pat. No. 8,141,705 are not of a structure able to be demounted and mounted anytime.

Second, golf bag is generally assembled in factories and then transported to dealers for sales. Customers cannot select components for assembling by themselves according to their own favors. At the same time, packing, shipment or transportation will occupy too much space and increase the transportation cost. Thus, the structure of golf bag in recent years tends to a demountable and mountable direction. Although the separator in the above-mentioned U.S. Pat. No. 8,141,705 can be demounted from the head frame; however, after demounted, it cannot be mounted on the head frame steadily. It is not of a demountable or mountable structure and thus unable to solve the above-mentioned problems.

SUMMARY OF THE INVENTION

The main purpose objective of the present invention is to provide a head frame for golf bag to solve the above-mentioned deficiencies. It is of a demountable and mountable structure, easy to be assembled and available for users to change the quantity of compartments in the head frame according to individual requirements. With a good using elasticity, a simple structure and a light weight, it can reduce the owner's transportation expenses significantly with a great practical value.

Consequently, to achieve the above-mentioned goal, this invention provides a head frame for golf bag, comprising an annular frame fitted with several inserting parts inside. These inserting parts include a slot with open side up and a guide block at one side of the slot, as well as a separator comprising an annulus which is complementary with the shape of this frame and inserted in the slot in a demountable way and a separating frame connected at inner side of this annulus to separate the inner side of the annulus into several compartments.

BRIEF DESCRIPTION OF THE DRAWINGS

The present invention will be more readily understood with reference to the accompanying drawings.

DETAILED DESCRIPTION OF THE INVENTION

Figure 1:
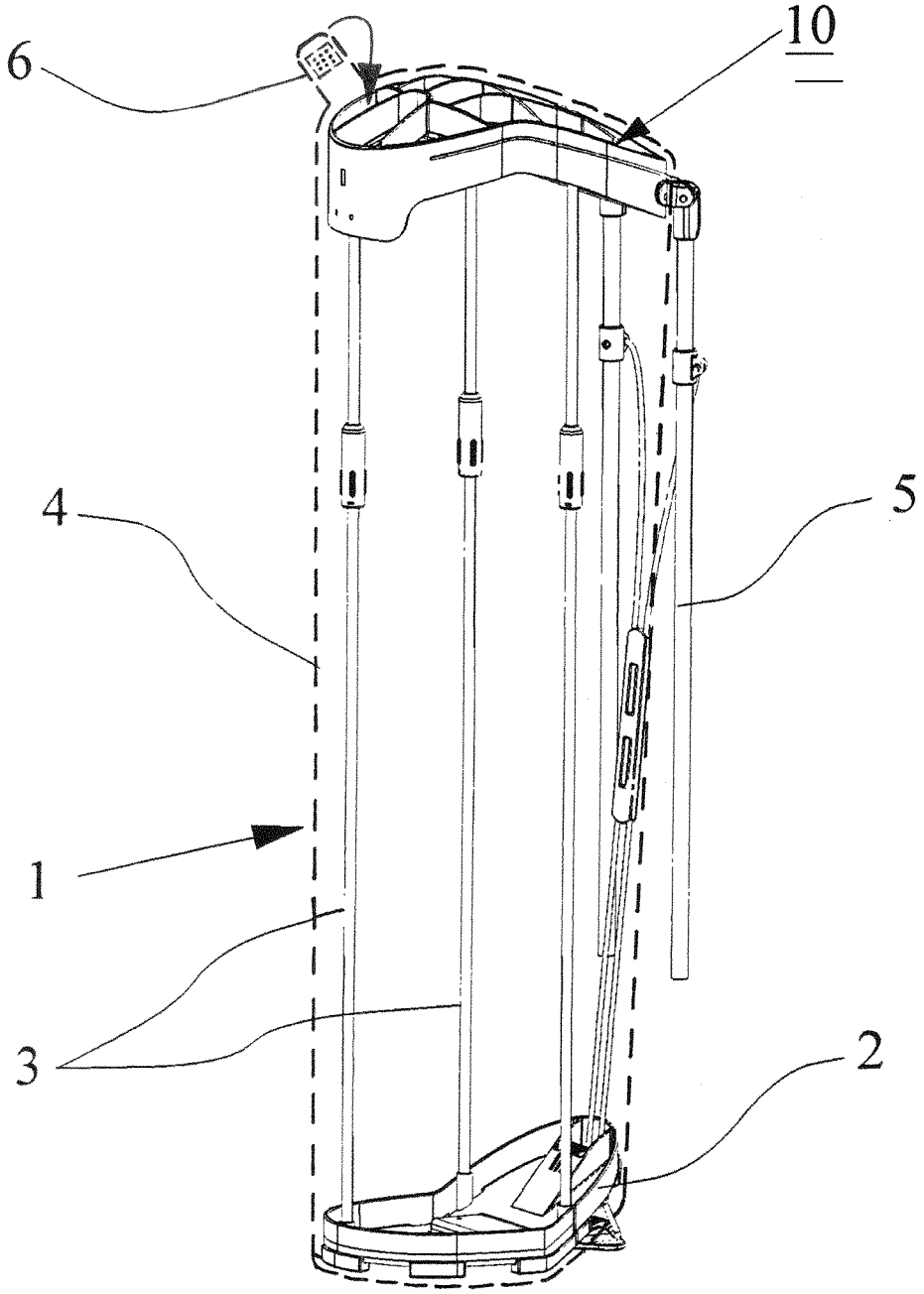
FIG. 1 is the outside drawing of a good example of this invention fitted in golf bag.
Figure 2:
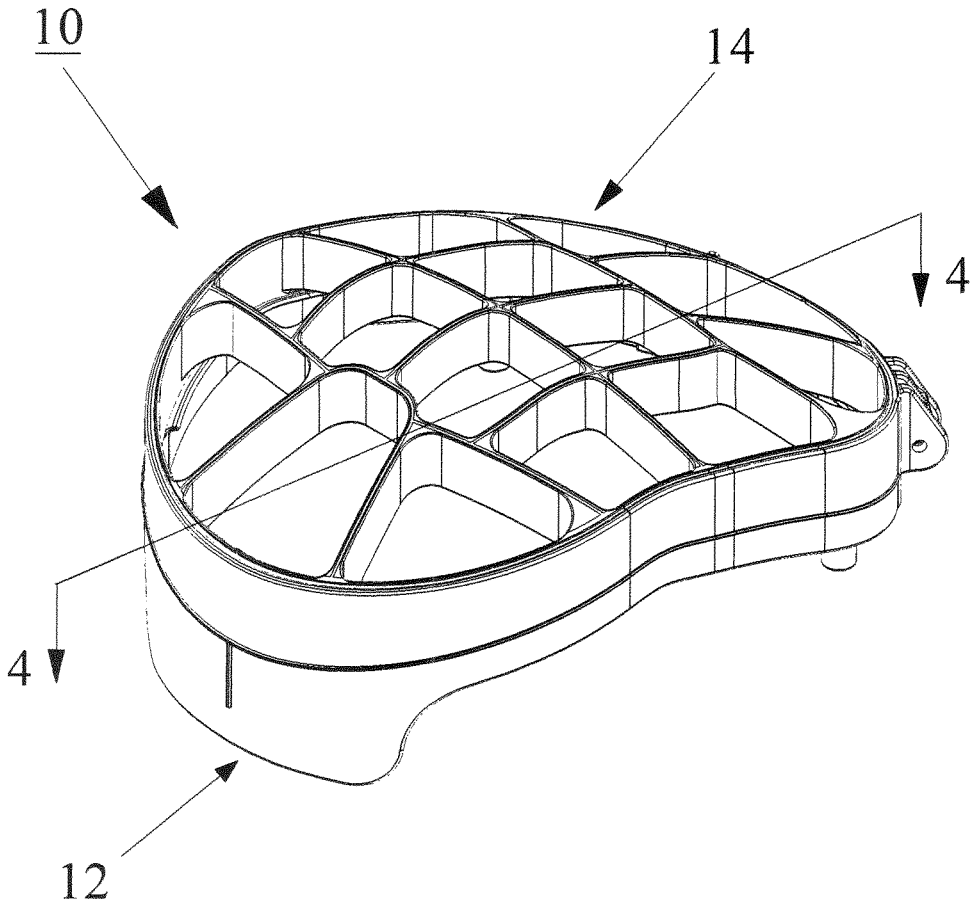
FIG. 2 is a spatial constitutional diagram of a good example of this invention.
Figure 3:
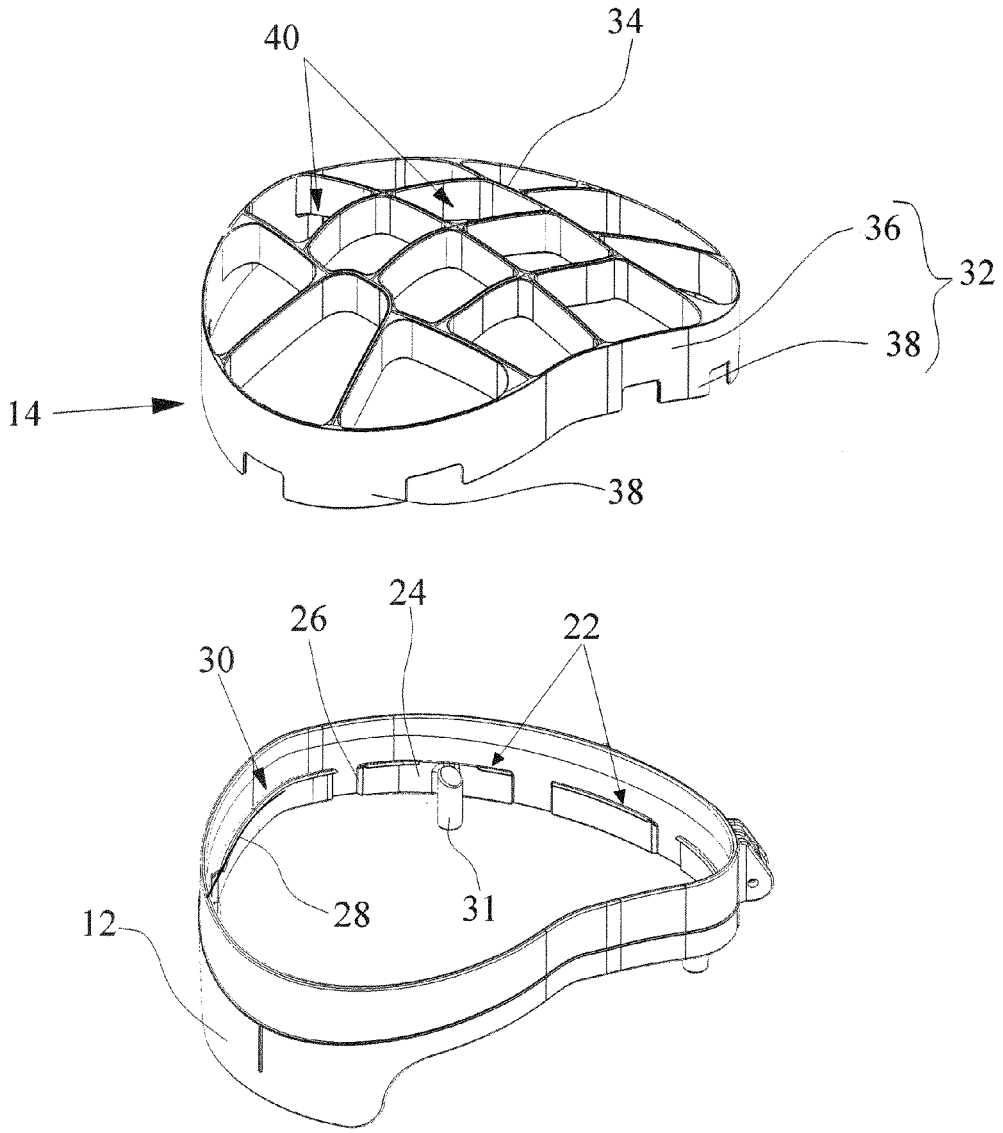
FIG. 3 is a spatial decomposition diagram of a good example of this invention.
Figure 4:
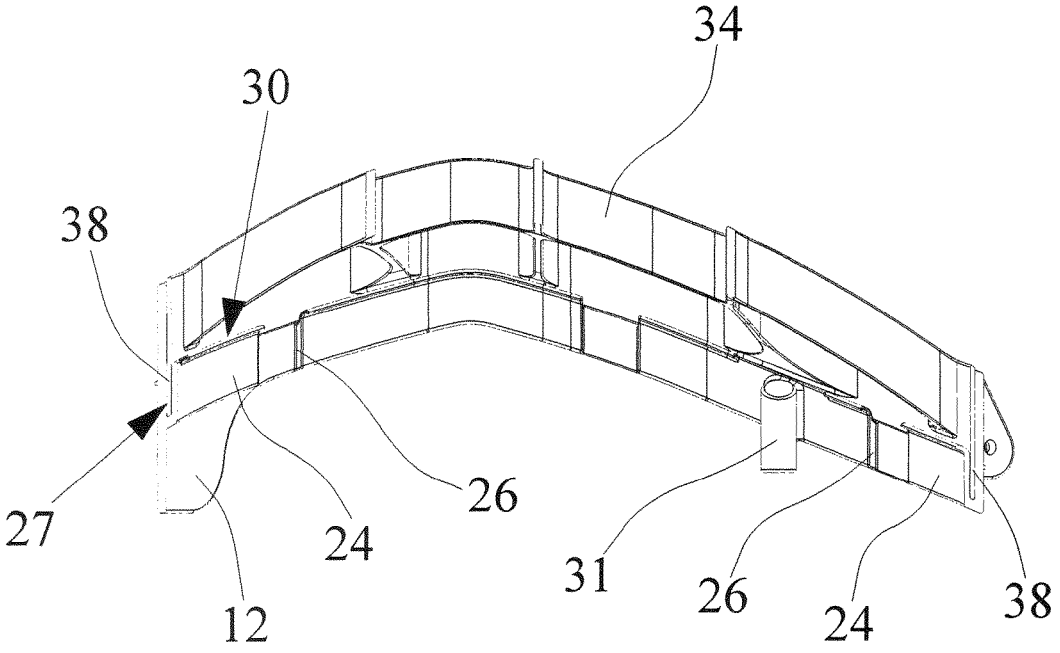
FIG. 4 is the sectional view along the 4-4 hatching line in FIG. 2.
Figure 5:
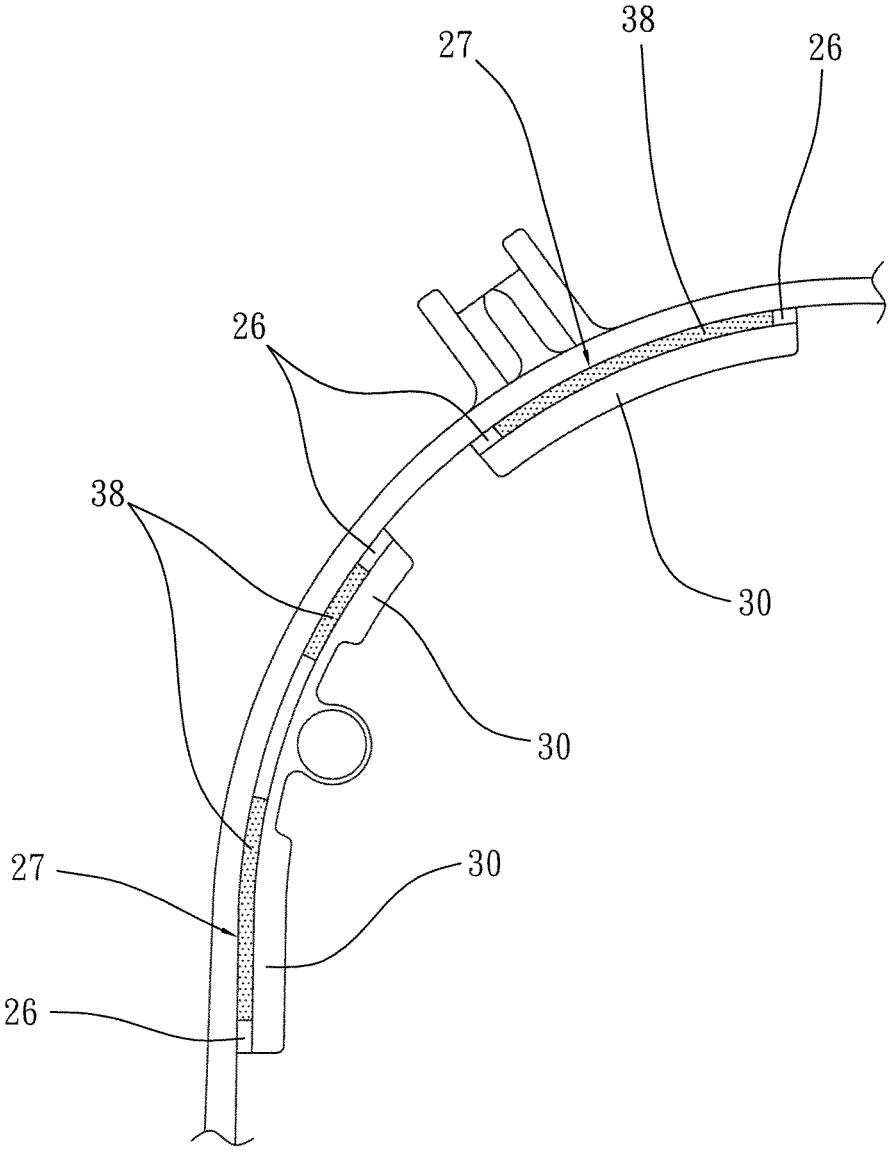
FIG. 5 is a bottom view of this invention.
Figure 6:
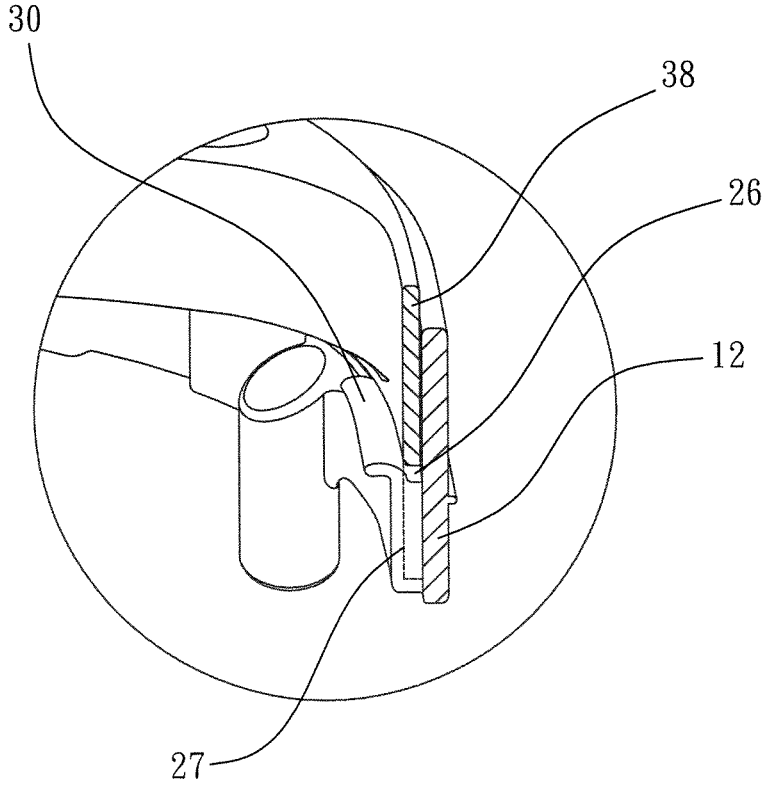
FIG. 6 is a sectional view of this invention showing the mating of the stop blocks and the inserting sheets.

A good example is given in the following contents and described in combination with diagrams in detail:

FIG. 1 to FIG. 6 is a good example of head frame 10 for golf bag 1. Golf bag 1 comprises a head frame 10, a base 2, a supporting rod 3 which connects the head frame 10 and base 2, a bag body 4 covering the head frame and the outer side of base 2 and a supporting frame 5. Where, the constitutions of the base 2, supporting rod 3, bag body 4 and supporting frame 5 are the same as those of general golf bag, which will not be described here. The head frame 10 comprises a frame body 12 and a separator 14, which is right the characteristic in this invention.

The frame body 12 is annular with a plurality of inserting parts 22 at the inner side, which include a sheet 24 and two stop blocks 26. These sheets 24 are connected with the frame body 12 at the bottom, while opposite to the frame body 12 from a preset distance at the top to form a slot 27 from the frame body 12. These two stop blocks 26 are fitted at both sides of the slot 27, enabling the slot with open side up. A guide block 28 is set on top of the sheets 24 and the surface of the guide block 28 is fitted with a cambered surface 30. A socket 31 is fitted at the outer side of the preset sheet 24 of a cylindrical shape with open side down, which is used for inserting of supporting rod 3 of the golf bag 1.

The separator 14 can be inserted into the slot 27 in a demountable way, which comprises an annulus 32 and a separating frame 34 at the inner side of this annulus 32. The shape of annulus 32 is the same as and complementary with that of the frame body 12. This annulus has a ring sheet 36 and a plurality of inserting sheets protruding at the bottom of this ring sheet 38, inserted in the corresponding slot 27 and between the two stop blocks 26. The separating frame 34 is connected at the inner side of ring sheet 36 to separate the inner side of the annulus 32 into several (e.g. more than 2) compartments 40 available for golf club placement. See FIG. 4-6.

Hereby, this bag body 4 connects the frame body 12 among all inserting parts 22 in a riveting way to constitute a connection relationship with the frame body 12. A plurality of protuberant tops 6 (single protuberant top is shown in this figure) for the bag body 4 cover the frame body 12 and annulus 32 from outside to inside, extend into the compartments 40 around the separating frame 34 and connect to the inner side of the bag body 4 by use of a buckle or other fasteners. At this time, the annulus 32 is located above the connection position of the bag body 4 and frame body 12, which will not affect the connection relationship between the bag body 4 and frame body 12.

Thereby, the characteristics of this invention, namely the head frame 10 of golf bag are described as follows:

The separator 14 can be inserted and mounted on frame body 12 in a demountable way. Thus users can replace the separator 14 of the separating frame with different shapes according to their individual requirements, so as to change the quantity of compartments 40 inside the head frame 10. Users only need to change the shape of annulus 32 into a shape the same as the frame body 12 for complementation, to meet their individual requirements and promote the using elasticity of golf bag 1.

Secondly, when assembling the separator 14 and frame body 12, the cambered surface 30 of all guide blocks 28 will guide the inserting sheet 38 to insert into the slot 27 easily for ease in assembling. Meanwhile, all inserting sheets 38 will not move (rotate) rightward or leftward inside the slot since restricted by all stop blocks 26, which will resist the longitudinal force from the separator 14. Moreover, this separator is bound by the plurality of protuberant tops 6, which will not pull out of the slot 27 of the frame body 12. Accordingly, the separator 14 and frame body 12 bond better.

Furthermore, this separator 14 inserts into the slot 27 via its inserting sheet, which will not only save the materials with a light weight, facilitate assembling but also reduce the owners' transportation expenses.

Obtain from above, head frame of the golf bag provided in this invention is composed of a separator and a frame body inserting and assembling in a demountable way. Thus users can change the separators with different compartment quantity to meet individual requirements and promote the use elasticity of golf bag. At the same time, this invention ensures the separator not to rotate against or pull out of the frame body based on the combination structure of all inserting sheets, slot and protuberant tops of the bag. It will not only save the manufacturing materials of the separator for a light weight and ease in manufacturing and assembling, but also reduce the owners' transportation expenses. Consequently, this invention is consistent with the stipulations about new-type patent. We hereby apply for a patent in accordance with law.

What is claimed is:

1. A head frame of a golf bag connectable to the top of a bag body of the golf bag, the head frame comprising:

an annular frame body with several inserting parts at an inner side thereof comprising:

a slot with an open side up;

two stop blocks arranged on both sides of the slot, the top blocks are configured to prevent the annulus from sliding in the slot;

a guide block with a cambered surface and arranged on top of the slot;

a separator with an annulus complementary with a section shape of the frame body and comprises a ring sheet and several inserting sheets protruding at one side of the ring sheet at preset intervals and inserted in the slot in a demountable way and such that the top blocks inhibit the annulus from sliding in the slot and a separating frame connected at an inner side of the annulus to separate the inner side of annulus into several compartments; and the bag body connects the frame body among all inserting parts in a riveting way to constitute a connection relationship with the frame body, a plurality of protuberant tops for the bag body cover the frame body and annulus from outside to inside, extend into the compartments around the separating frame and connect to the inner side of the bag body.

2. The structure defined in claim 1, wherein the frame is fitted with several slots with a number equal to the inserting sheets.

3. The structure defined in claim 1, further comprising several sockets at the outer side of the preset sheet for placement of supporting bars of golf bag.

4. The structure defined in claim 3, wherein each socket is of a cylindrical shape with open side down.

* * * * *